US006368176B1

(12) United States Patent
Lozowski et al.

(10) Patent No.: US 6,368,176 B1
(45) Date of Patent: Apr. 9, 2002

(54) TEXT/ICON DISPLAY PREDICTOR ENTERTAINMENT DEVICE

(75) Inventors: Joseph F. Lozowski, Carson City, NV (US); Edward C. McKinney, San Rafael, CA (US)

(73) Assignee: Sharper Image Corporation, San Francisco, CA (US)

( * ) Notice: Subject to any disclaimer, the term of this patent is extended or adjusted under 35 U.S.C. 154(b) by 0 days.

(21) Appl. No.: 09/393,720

(22) Filed: Sep. 10, 1999

(51) Int. Cl.[7] ..... A63H 5/00
(52) U.S. Cl. ..... 446/397; 446/169
(58) Field of Search ..... 446/169, 397, 446/404, 409; 273/161, 139

(56) References Cited

U.S. PATENT DOCUMENTS

| | | | | | |
|---|---|---|---|---|---|
| 3,119,621 | A | | 1/1964 | Bookman | 273/161 X |
| 3,168,315 | A | | 2/1965 | Bookman | 273/161 X |
| 3,675,241 | A | | 7/1972 | Glaser | |
| 3,740,039 | A | | 6/1973 | Prola | 273/161 |
| 3,798,833 | A | | 3/1974 | Campbell | 273/161 X |
| 4,054,286 | A | | 10/1977 | Dressler, Sr. | 273/161 |
| 4,072,314 | A | | 2/1978 | Rosen et al. | 273/161 |
| 4,765,623 | A | | 8/1988 | Cardillo et al. | 273/161 |
| 5,314,336 | A | * | 5/1994 | Diamond et al. | 446/169 |
| 5,375,839 | A | * | 12/1994 | Pagani et al. | 446/409 |
| 5,476,407 | A | * | 12/1995 | Hall, Jr. | 446/404 |
| 5,479,529 | A | | 12/1995 | Nakagawa et al. | 273/161 X |
| 5,482,277 | A | | 1/1996 | Young | |
| 5,775,695 | A | * | 7/1998 | Byers | 446/161 |
| 5,971,827 | A | * | 10/1999 | Lee et al. | 446/404 |

* cited by examiner

*Primary Examiner*—Sam Rimell
(74) *Attorney, Agent, or Firm*—Fliesler Dubb Meyer & Lovejoy LLP

(57) ABSTRACT

A fortune telling entertainment device includes an electronic library of stored text and displayable icons, one of which library entries is selected, preferably at least quasi-randomly, and displayed in apparent response to a user's question. The user preferably shakes the device, which motion initiates a pre-answer period during which optional entertainment display and sound may be output. After initiation is completed, a circuit selects, at least quasi-randomly, a response that is then displayed as an answer to the user's question.

12 Claims, 3 Drawing Sheets

TEXT/ICON DISPLAY PREDICTOR ENTERTAINMENT DEVICE

FIELD OF THE INVENTION

The present invention relates generally to entertainment devices including hand-holdable entertainment devices, and more particularly to such devices that purport to predict the future and answer user's questions.

BACKGROUND OF THE INVENTION

Humans have long sought to learn what the future may hold for them. Over the millennia methods and devices for predicting the future have ranged from shaman reading the entrails of animals, to astrologers, and phrenologists. In more modern time, fortune telling has assumed a role that is more entertaining than serious.

A very popular fortune telling entertainment device is the so-called "Magic Eight Ball" product. This device typically is sized and shaped to look like a pool eight-ball. The device is hollow, filled with a liquid and has a transparent window at the bottom or base of the device. Within the device is a multi-surfaced float with different "answers" printed on the different surfaces. The number of answers is limited by the number of surfaces on the float, and is typically less than perhaps a dozen or so.

In practice, a user might ask the device a question, for example, will this application result in a patent. The user then shakes and inverts the device. Eventually the float rises and presses a surface (with an answer) against the window, which is now facing upward. The "answer" might be "yes", or "not obvious", or some other saying.

Since the device preferably is hand-holdable, the sphere portion of the ball is typically a few inches (perhaps 5–6 cm) in diameter. This dimension more or less dictates a maximum size for the float, and thus a maximum number of float surfaces. While creating more surfaces or facets on the float can allow for more answers, the size of the font with which the answers are printed or stamped into the float surfaces decreases. This in turn makes it harder to read smaller and smaller answers from a device that tries to provide a greater number of answers. Often the type with which the answer is printed is font size 10 or so. Further, such devices can be difficult to read under the best of circumstances, especially by elderly people or others with diminished eye sight.

The different "answers" of course appear more or less randomly, which promotes enjoyment, especially when the "answer" is incongruous to the question. However, for spectators observing an individual using the device, their enjoyment will be somewhat delayed because only one person at a time can read the answer. Often the person holding the device will see the answer and, if it is not too embarrassing, will then read it aloud, whereupon the spectators can join in the fun.

However due to the relatively small number of answers, the entertainment value of such devices can soon wear off. Unfortunately there is no way to open the device and change floats to change the collection of potential answers as the device is sealed during manufacture. Another deficiency is that children used to electronic devices may become bored with such a purely passive device. Further, the liquid-filled device is relatively heavy and fragile and can break if dropped, with resultant leakage of fluid over the floor or carpet area.

In short, there is a need for an entertainment fortune predicting device that can provide longer entertainment value. Preferably such device should provide a relatively large number of responses, perhaps a hundred or more, and should provide such responses using an electronic display so that all may instantaneously share in the response. Such device should optimally provide an ability to alter the library of answers, including the ability to permit a user to input responses for display. Finally, such device should be relatively inexpensive to produce, light in weight, robust, and useable even by children and elderly persons.

The present invention provides such a device.

SUMMARY OF THE INVENTION

The invention is a fortune telling device that digitally spells out a selected answer to a question using a marque display (e.g., using segmented LED or LCD display elements), or an electronic flat panel display (e.g., an LCD screen) that optionally can also display icon-like symbols, especially useful for children. If desired, the display may be a ring of discrete LEDs that are activated one at a time, roulette-wheel fashion, with a selected one of the LEDs remaining on after the random selection. A text or icon or symbol indicia is contained on the device housing in this embodiment, with each LED corresponding to one indicia, the activated LED thus indicating the answer.

Selection may be random or at least quasi-random. If the number of potential answers is sufficiently large it can suffice to select and provide answers sequentially, or perhaps selecting and provide every second answer or every third answer, etc. and after exhausting the list of answers, returning to the start of the list but now selecting answers not selected the first time, and so forth. The term quasi-random will refer to such a selection mechanism, in which a goal is not to bore a user by selecting the same answer two or three times in immediate succession.

In the various embodiments, the device preferably is hand-holdable and provides a spherical shaped housing having a flattened base portion. Alternate housings are possible, including a figure-shape character (perhaps genie-like in appearance), a mirror, and a wall hanging. Preferably at least one sense mechanism, electronic circuitry, an electronic display, optional sound transducer and entertainment light sources, and a battery power source are disposed within the housing.

Even before a user "asks" the device a question by shaking the device and speaking aloud, a preferably motion-type sense mechanism detects the intent to use, and commences pre-answer initiating activity, including an optional display of non-answer text and optional display of lights, preferably using LEDs. The user's intent to use the device may be sensed with a mechanism that includes any or all of a motion unit to detect user shaking of the device, a strain unit to detect physical touching or holding of the device, a proximity detector to detect closeness of a user, a sound detector to detects a user's approach or spoken sounds. Thus for a device that is not hand-holdable, the user can "ask" the question, or touch the device and then ask the question. Preferably the device will seem to sense that a user expects it to provide an answer, as manifested by a pre-answer display of text and/or a visual light display and optional sounds. An optional eccentrically mounted weight is mounted to rotate within the housing as the device is moved, to promote the sensation of activity within the device.

Within the device housing, output from the sense mechanism activates electronic circuitry that optionally commences one of several pre-answer initiation-period displays (and any optional sound and optional light display). Pre-answer initiation-period displays can include electronically displayed text such as "uuh, ooh" or "what now?", "here we go again", or the like. Such text may be spelled out marque-fashion using several LED or LCD display elements, or may be spelled out on a panel display, which panel can also display entertaining icons and symbols. In one embodiment, a group of LEDs encircle the device perimeter, roulette wheel-like. During the pre-answer display, these LEDs may flash first clockwise, then counter-clockwise, etc. In the various embodiments, intensity of the pre-answer visual display may be changed in proportion to detected movement of the device.

Regardless of how initiation is sensed, in a preferred embodiment, a certain number of initiation activities should occur within a certain time period, e.g., three shakings of the device within say four seconds, before an answer mode is entered. Each sensed shaking (or other activity) preferably can produce a visual display.

After the last (required) initiation activity within the time period, an answer is selected for display. In one embodiment, the answer is selected randomly by a randomizer circuit from an electronic library that may include a hundred or more answers, pre-stored preferably in digital format. The randomizer circuit and electronic library are provided by the electronic circuit. If desired, the randomizer may simply select quasi-randomly, for example selecting successive answers sequentially (especially if there are a large number of potential answers), or selecting every other answer as successive answers, etc. However the selection is made, the selected answer is then displayed, for example using display elements, a display panel, or the like, for viewing by the user and any spectators in the general area.

In one embodiment, the display comprises a group of LEDs that encircle the device, roulette wheel fashion, with text and/or icon or symbol indicia on the device housing associated with each LED. During an answer selection period various of the LEDs are activated to produce an entertaining display, but once the answer is determined a single LED remains on, and its associated indicia provides the answer.

The answers need not be limited to merely "yes" and "no" but can include a wide repertoire including humorous and sarcastic responses, for example text or indicia indicating "Oh sure" or "Give me a break". Optionally the electronics can include memory permitting the user to input for later display some or all of the answers. Such input may be accomplished using a computer whose user-provided answers are output in a text format.

If desired, a "cheat" switch can be activated by a user to select a random answer that may be customized, for example, between a first characteristic and a second characteristic, e.g., a male rather than a female user, or vice versa. If a true randomizer circuit is used, optionally the circuit is programmed to reject an answer that has been recently displayed. After displaying the selected answer, the battery connection is interrupted, turning off the device and preserving battery life.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1B:
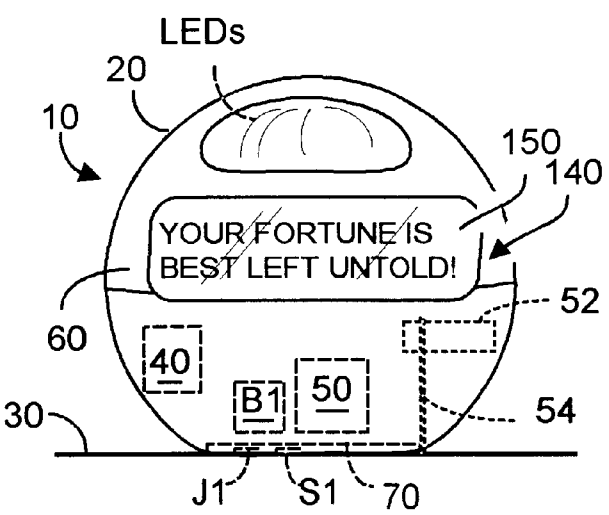
FIGS. 1A–1C are perspective views of hand-holdable sphere-like embodiments of the present invention.
Figure 1A:
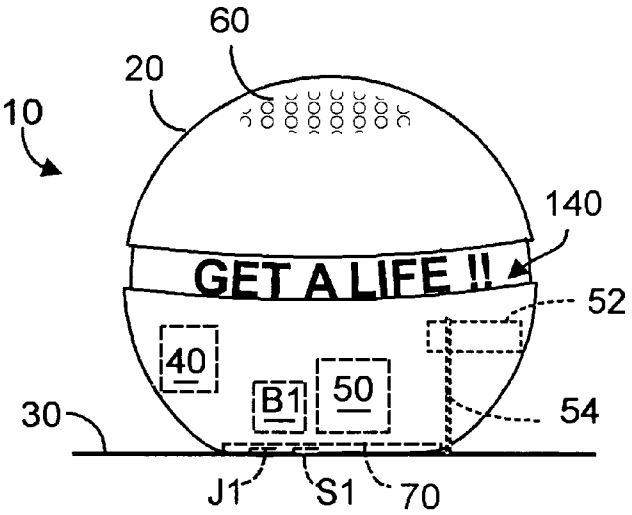
Figure 1C:
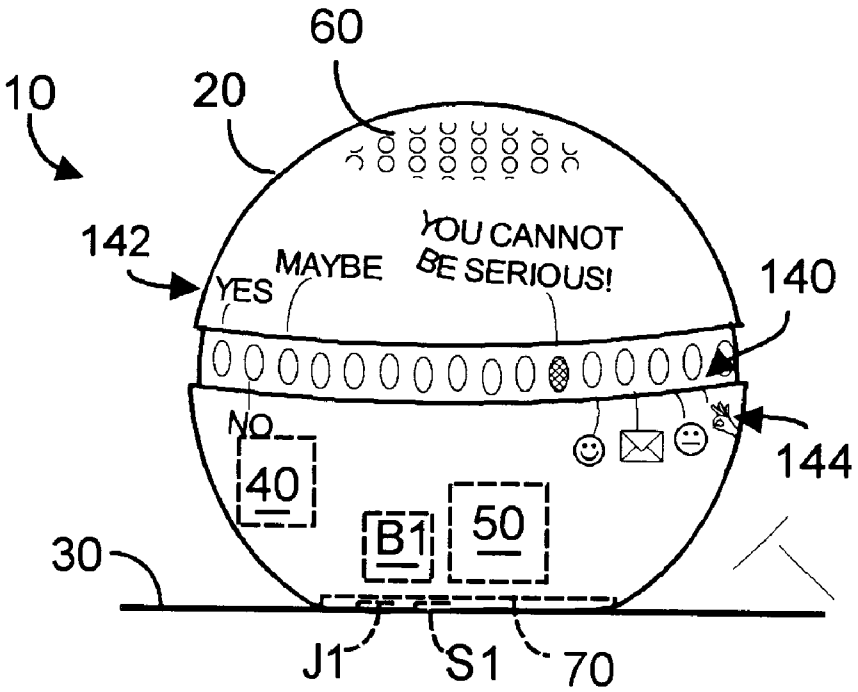

FIGS. 1A–1C depict preferred embodiments of the present invention 10 as including a generally spherical housing 20 whose bottom region is preferably sufficiently flat to sit stably atop a surface 30, for example a table. This configuration has been found to be extremely robust, for example, permitting the invention to be dropped onto a floor from a height of 1 m without damage. Of course other device shapes may be used including, without limitation, a frame mirror or picture.

Housing 20 preferably is made from a light weight plastic, ABS material for example, and a housing diameter of perhaps 6 cm to 11 cm might be used although other materials, housing shapes, and dimensions could be used. In the preferred embodiment, B1 comprise four series-connected AA batteries, although other battery types may instead be used. Alternatively, a wall adaptor AC:DC converter may used with DC operating potential being coupled to device 10 through a suitable input jack. Housing 20 may include a hatch 70 providing access to battery B1, and to user controls that need not be frequently adjusted, for example a display contrast control.

A passive movement enhancing mechanism such as a weight 52 that is mounted off-center upon a spin axis 54 may be included. Thus, when device 10 is lifted and moved, weight 52 will contribute to the sensation of activity within the device. If desired weight 52 may be associated with a spring mechanism that winds or unwinds relative to axis 52 to further enhance such sensation of internal activity. If desired more than one weight-axis combination may be provided, preferably with different spin axes.

In the various embodiments of FIGS. 1A–1C, device 10 includes at least one sense mechanism 40, an electronic circuit 50, a battery unit B1, an optional weight 52 eccentrically mounted for rotation about an axis 54, an optional sound emitter such as a piezo electric transducer 60, and a visual display mechanism. Housing 20 preferably also includes at least one user-operable control, e.g. S1, and at least one jack, e.g. J1. Without limitation, sensing mechanisms 40 may include any or all of a motion sensing switch 40-2, a strain detector 40-4, a proximity detector 40-6 (e.g., infrared red including PIR and/or motion sensing), and an ambient sound detector 40-8. The function of these pre-answer initiation period sensing mechanisms is to detect a user's intent to use the device, typically manifest by the user's holding or shaking the device, or approaching the device, or making noise or other sounds in the vicinity of the device.

In FIG. 1A, display mechanism 140 is a plurality of display elements, LED, LCD, etc., arranged in marque fashion to spell out words. Such display elements are known in the art and commonly comprise seven or more segments. In FIG. 1B, display mechanism 150 includes a panel display, preferably an LCD unit. In FIG. 1C, display mechanism 140 is a roulette-like ring of LEDs encircling housing 20, with various indicia 142, 144 printed on the housing adjacent individual LEDs. In the embodiment of FIG. 1C, an answer is provided by one of the LEDs remaining on during the answer period. The word indicia 142 or the icon or symbol indicia 144 associated with the LED is the answer. Understandably icon or symbol indicia 144 can be especially useful for children too young to read.

In the embodiments of FIGS. 1A–1C additional display components may also be provided, e.g., LEDs (indicated in FIG. 1B) that are used primarily to augment the visual display during the pre-answer and answer stages of the device. Thus, when device 10 is first activated during the pre-answer period, preferably LEDs (or equivalent) will be visible on or within the wall of housing 10. If desired, a transducer 60 may also emit beeps or other entertaining sounds.

In FIG. 1A, device 10 is shown spelling out a response "Get a life" on display mechanism 140, ostensibly in response to a question posed by a user. As noted, during the pre-answer period, display mechanism 140 might be used to spell out a statement such as "here we go again", or "give me a question". By marque-fashion it is meant that the number of discrete display elements in FIG. 1A is limited to perhaps twenty or so, and that messages longer than twenty characters will be scrolled.

In the embodiment of FIG. 1B, the display mechanism is an LCD panel 150, here shown spelling out a response "Your fortune is best left untold!", although the spelled-out words could instead be a pre-answer statement, e.g., "What would you like to learn?". LCD panel 150 may also be used to display indicia rather than only alpha-numeric symbols.

In the embodiment of FIG. 1C, display mechanism 140 comprises a plurality of light sources, preferably LEDs, that encircle the perimeter of the device, activating one after the other. When it is time to give the answer, only one LED remains on, and the indicia or icon on the device housing adjacent that LED provides the answer. Thus in FIG. 1C, the LED adjacent the indicia "You cannot be serious" has remained on during the answer period, thus giving as an answer the associated statement. Had the LED immediately to the right (in FIG. 1C) remained on, the answer would be given by the happy face icon, indicating good tidings or whatever other good thoughts the user wishes to read into this answer.

In the various embodiments, one or more auxiliary LEDs, driven by a driver 120, may also be activated, sequentially and/or simultaneously, to provide an entertaining light show, before or during after the "answer". Thus, it will be appreciated that device 10 can provide both audible and visual entertainment that can be enjoyed by more than one person simultaneously.

Figure 2:
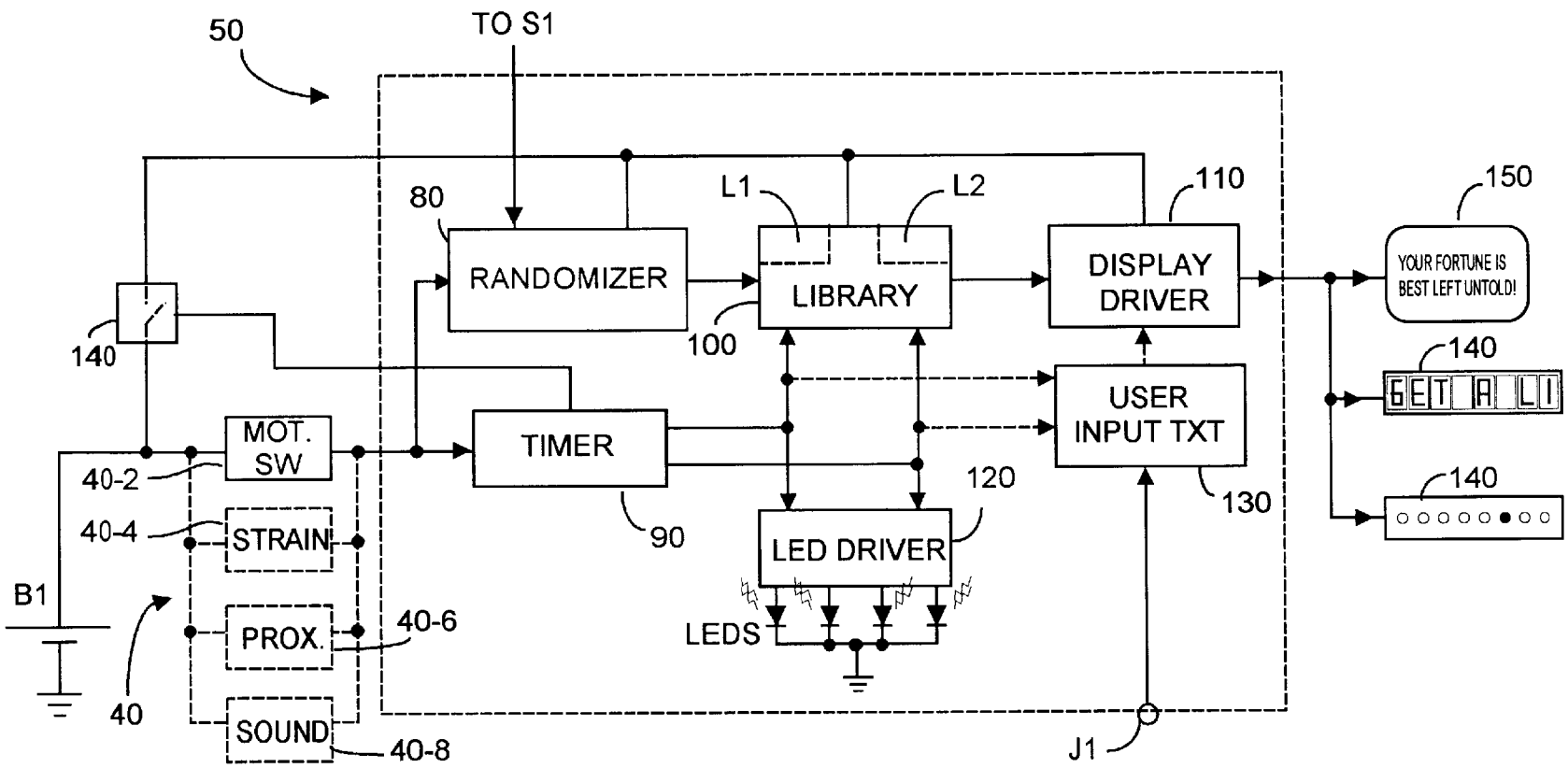
FIG. 2 is a block diagram of a preferred embodiment of the present invention.

FIG. 2 is a block diagram of circuitry 50. Circuit 50 preferably includes a randomizer unit 80, a timer circuit 90, an electronic library of text or equivalent format messages 100, a display driver 110, an LED or other light source driver 120 (if device 10 includes optional LEDs or light sources), and optionally a unit 130 that may receive text or equivalent input data. Such data may be downloaded by a use via jack J1, perhaps using a PC computer. The user-input text might, for example, be tailored to a birthday party and include answers, to be displayed on device 10, mentioning party guests by name, and so forth. If an LCD display 150 is used, unit 130 might be used to receive displayable icons rather than pure text. Depending upon the sophistication of the device, the icons could in fact be user-input images of party guests and the like.

In practice, a user will approach device 10 and initiate the pre-answer period. As noted, detection of the user and on-set of the pre-answer initiation period can be accomplished using a variety of sensing methods ranging, without limitation, from PIR to voice detection and recognition, to strain detection, to detection of mechanical vibration. During or after this process a user will enunciate a question to be "answered" by the device.

One or more mechanisms 40-2, 40-4, 40-6, 40-8 (or other sensor mechanism types) will sense this pre-answer initiation period activity and will cause activation of circuit 50. For example, in response to vibration or shaking, motion switch 40-2 closes at least intermittently, which provides at least a pulse of voltage from B1 to a timer circuit 90. The intermittent pulse also causes an electronic switch 140 (e.g., a MOS FET) to be closed by timer 90, which now receives operating potential independently of the state of the motion switch or other sensing mechanism. Of course other circuit configurations may instead be used.

A motion switch sense mechanism 40-2 may be implemented in many ways. For example, a multiple leaf type switch may be used where motion vibrates at least one leaf into electrical contact with an adjacent switch pole. If desired, a conductive pendulum may be suspended through a conductive eyelet or loop such that in a rest position the pendulum does not contact the loop. However if the device is moved, such vibration will cause the pendulum to swing slightly, making electrical contact with the surrounding loop. A motion switch may be constructed using dual concentric contacts, such that mild vibration may be distinguished from heavy shaking. The outputs from such a motion switch may advantageously be used to command "mild motion" type pre-answer sounds as contrasted with "heavy motion" type pre-answer sounds.

One or more strain gage sense mechanisms 40-4 may be mounted on or in the wall of housing 20. When a user touches or holds device 10, the resultant physical contact will produce mechanical strain in housing 20, which strain is detected by strain gage(s) 40-4. Stress gages 40-4 then perform the functions described above for motion detector 40-2.

If desired, initiation can be sensed with a proximity switch 40-6 that may be implemented using capacitive coupling, IR detection, PIR, RF doppler, among other techniques. As a user approaches device 10, proximity switch 40-6 detects the approach and performs the functions above-noted for the motion switch.

It may also be useful to provide a sound sense mechanism 40-8 that can perform the role of motion switch 40-2 but in response to ambient sound. Ambient sound could include footsteps or speech made while approaching the device, and indeed could include speech recognition sensing such that a given user (perhaps the owner of the device) might be recognized by voice patterns using electronics within device 10. A sound detecting sense mechanism is especially useful if device 10 is too large or too heavy to be handheld, for example a large figurine such as shown in FIG. 1C. Unlike many prior art devices, preferably all of the sensors with which the invention may be used can operate even without ambient light.

A combination of proximity and motion detection can permit enhancing the visual and any sound transducer effect(s) that are activated during the pre-answer initiation period. For example, when proximity is detected, device 10 could be caused to display the words, "Here comes trouble" or some other initiation-appropriate text selected preferably randomly or at least quasi-randomly from library 100. If motion is sensed, device 10 could display words such as "I am getting dizzy" or "enough already!", and so forth.

Responding to motion and/or strain and/or proximity detection, electronic switch 140 will latch closed until such time as it is permitted to open in response to a signal denoting that the end of the displayed answers has occurred. Many other operational configurations are possible. Preferably, however, the connection between battery B1 and circuit 50 is interrupted almost immediately after the conclusion of a displayed answer to conserve battery life.

As noted, in a preferred embodiment, the initiation period will include a certain number of events, for example three discrete shakings of the handheld device, within a time period. The number of events and time period preferably are programmed into circuit 50, and could if desired be made user-variable. In any event, at the conclusion of the pre-answer initiation period (for example, after the third vibration within say four seconds), circuit 50 enters the answer phase of operation.

As shown further in FIG. 2, initial pulse(s) from the motion (or other) switch preferably are also coupled to a randomizer circuit 80, whose output will be a digital value that is randomly selected. In the preferred embodiment, randomizer circuit 80 includes a pseudo-random number generator that has a different seeding with each activation. Other randomizing function implementations may be used, however. Preferably randomizer 80 can maintain a recent history of selected responses such that the same response will not be selected for display twice in a row. The randomizer output is used as a pointer to a location or locations within memory 100, from which location a randomly selected answer is selected for viewing.

As noted, it may suffice for randomizer circuit 80 to carry out merely a quasi-random function. In the preferred embodiment, memory unit 100 may store one hundred or more potential responses. For the embodiments of FIGS. 1A and 1B it would suffice if randomizer circuit 80 made selections sequentially, e.g., on one round of use selecting response number 1, on the next round of use selecting response number 2, on the next round of use selecting response number 3, etc. Alternatively, a quasi-random function might select response number 1 on round one of use, response number 3, then response number 5, and until reaching the end of the library, whereupon response number 2 then response number 4 then response number 6, etc. would be selected in turn. One purpose of having a randomizer circuit is to reduce foreseeability of the next response. Thus, for the indicia embodiment of FIG. 1C a true randomizer circuit would be preferred, as a sequential-type response would soon because obvious to the user and spectators.

If desired, certain answers in the L2 portion of library 100 may be categorized according to characteristics, e.g., "happy answers", "sad answers", "neutral answers", "serious answers". If the randomizer selects, for example, a "happy answer", circuitry 50 could recognize this fact by the randomly selected answer address and could command activation of an appropriate display pattern via driver 120 of LEDs, as well as the display on unit 140, 150 of an approximate text and/or icon.. For example, if multicolored LEDs are used, perhaps green and red LEDs would be activated for a happy answer, perhaps blue LEDs for a sad answer. Driver 120 actuated LEDs can augment the entertainment value of device 10, and can be activated in series, parallel, or a combination of each. Circuit details for activating LEDs in sequence or otherwise are well known to those skilled in the relevant art and are not given here.

Optionally randomizer 80 can provide a linkage between subsequent answers, in anticipation that a subsequent question is related to a previous answer. Such linkage affects the otherwise randomness of unit 80, but can produce entertaining results. For example if a previous response was "No", the subsequent response might be "I thought I just replied no". The randomness of unit 80 can also be intentionally altered by the magnitude of the initiation activity. Thus, hard shaking might be interpreted as meaning a more serious question is about to be propounded, or that the present user is a male. The random answer could then be selected from a portion of library 100 known to contain responses suitable for such assumptions.

The dynamic range of the digital output is scaled such that a quantized random value will define one of a plurality of storage addresses in a library 100. Library 100 holds preferably one hundred or more different displayable text and/or icon or symbol answers. If desired, the library contents may be thought of as including library contents L1 and L2, where for example L1 represents a library of a dozen or so text and/or icons (for the embodiment of FIG. 1B), selectable during the device pre-answer initiation stage. In the preferred embodiment, library 100 is a microcontroller embedded with memory that may be internal or external, for example, a removable flash memory card. Other implementations are of course possible.

Thus, during the few seconds that a user repeatedly shakes (or otherwise initiates) device 10, a text/icon will be selected, randomly or quasi-randomly (which includes sequentially, as noted herein) from L1 can be selected from library 100, and displayed via driver 110 and display 150 or 140. As noted, other LEDs driven by driver 120 may also produce a visual display during this time. If desired, a motion switch could be augmented by a strain type transducer such that excessive shaking motion could dictate one of a select few stored library text phrases, e.g., "don't break me", for display, regardless of the randomizer output.

In contrast to prior art Magic Eight Ball type devices, the "answer" can be immediately known to all persons within view of the device, not just to the user. This enhances the entertainment value, especially where a user dissatisfied with a Magic Eight Ball visual answer might not announce the answer and simply re-shake the Magic Eight Ball.

An LED display could occur from the time of the shaking through the end of the answer dos[;au. or some shorter period of time. After the answer has been displayed, circuitry 50 causes electronic switch 65 to open, terminating any audio as well as the visual display. At this juncture, battery B1 is effectively disconnected from circuitry 50 until a sensor mechanism again causes electrical connection to be made.

In a preferred embodiment, one or more of the answers stored in L2 in library 100 may be recorded by entertainment celebrities, whose voices will be instantly recognized by most listeners. Funny answers might be recorded by comedians, tragic answers by tragedians, and so forth.

Although the answers are preferably randomly or at least quasi-randomly selected by randomizer 80, if desired a "cheat" function could be implemented with a user-operable control S1 to at least determine which of at least two characteristics the randomly selected answer shall exhibit. For example, answers suitable to a male interrogator might be stored in a certain block of addresses within library 100, whereas answer suitable to a female interrogator might be stored in another block. A male user wanting "male" appropriate answers might push or otherwise activate switch S1, whereas a female user might not activate S1 (or vice versa). The randomizer would then be forced to randomly select an answer, but from the male appropriate block of addresses or from the female appropriate block of addressed.

Some answers might be termed "happy" answers, e.g., "fortune lies ahead", whereas others might be "sad" or "disappointing" answers, e.g., "get a life". Switch S1 or a second switch could be incorporated to command at least the mood of the answer, although the answer would still be randomly selected, albeit from the S1 (or other switch) selected mood of answers.

If desired, a specific answer might be given more than one address within memory 100, to permit a variable weighting and to save memory space. Thus, "fortune lies ahead" might be indexable both as a "happy" answer and as a "serious" answer. Further, it will be appreciated that some or all of memory 110 may be implemented as removable memory, including memory insertable into device 10 as PCMCIA memory. Thus, a device 10 intended for use by children might have a library 100 of answers appropriate for children recorded by parents or older siblings. However, different libraries of displayable answers could readily be provided simply by removing one library 100 and inserting another. One library 100 might have answers appropriate for children, another for adults, and so forth.

Specific electronic circuit details have not been provided as those skilled in the art will readily understand from FIG. 2 how the present invention may be implemented.

As was noted, many prior art devices provided visual-only entertainment from a limited selection of answers that were viewable by a single user, until the answer was read aloud or the device passed around so others with good enough eyesight could also read the answers. By contrast, the present invention provides visual entertainment on a scale sharable by many individuals, as well as optional audible entertainment. In the present invention, the number of storable displayable responses may readily exceed one hundred using conventional off-the-shelf solid state library storage integrated circuits.

Modifications and variations may be made to the disclosed embodiments without departing from the subject and spirit of the invention as defined by the following claims.

What is claimed is:

1. A method of entertaining a user with a fortune telling device, the method comprising the following steps:

(a) providing a hand-holdable device adapted to allow a user to verbally address a question that will appear to be answered by said device;

(b) sensing user intent to use said device;

(c) providing a library storing potential responses;

(d) selecting one of said responses ostensibly in response to a question verbalized by a user to said device; and (e) textually displaying a selected said response as an answer by said device to the question verbalized by said user, including providing a display that includes a marque of discrete display elements, each of said elements able to display at least one alpha-numeric character.

2. A method of entertaining a user with a fortune telling device, the method comprising the following steps:

(a) providing a hand-holdable device adapted to allow a user to verbally address a question that will appear to be answered by said device;

(b) sensing user intent to use said device;

(c) providing a library storing potential responses;

(d) selecting one of said responses ostensibly in response to a question verbalized by a user to said device; and (e) electronically displaying a selected said response as an answer by said device to the question verbalized by said user, including providing a panel display able to display at least one of (a) the phrase of text (b) an icon, and (c) a symbol.

3. A method of entertaining a user with a fortune telling device, the method comprising the following steps:

(a) providing a hand-holdable device adapted to allow a user to verbally address a question that will appear to be answered by said device, including providing a housing that includes indicia and a user-viewable display to electronically display said response;

(b) sensing user intent to use said device;

(c) providing a library storing potential responses;

(d) selecting one of said responses ostensibly in response to said question verbalized by said user to said device; and (e) electronically displaying a selected said response as an answer by said device to the question verbalized by said user, including providing a display that has a plurality of light sources arranged on said housing in 1-to-1 relationship said indicia on said housing;

wherein a displayed said response is displayed by activating one of said sources after said selection, said response being given by indicia associated with the activated one of said sources.

4. The method of claim 3, wherein step (b) includes disposing, within said device, a mechanism to detect user intent to use said device.

5. The method of claim 4, wherein step (b) includes disposing within said device at least one mechanism selected from a group consisting of (a) a motion sensor, (b) a strain sensor, (c) an infrared sensor, (d) a range sensor, and (e) a sound detection sensor.

6. The method of claim 4, wherein:

step (b) includes said mechanism, upon detecting user intent, causing activation of a pre-response display selected from a group consisting of (i) activating at least one light source, (ii) activating a marque-like display of text, (iii) activating a panel display of text, and (iv) activating a display of at least one icon.

7. The method claim 4, wherein:

step (a) includes disposing said device within a housing;

step (b) includes detecting conclusion of a pre-response period; and step (e) includes activating a response display selected from a group consisting of (i) activating at least one light source associated with which is an indicia on said housing, (ii) activating a marque-like display, disposed on said housing, of response text, (iii) activating a panel display, disposed on said housing, of response text, and (iv) activating a display of at least one response icon disposed on said housing.

8. A method of entertaining a user with a fortune telling device, the method comprising the following steps:

(a) providing a hand-holdable device adapted to allow a user to verbally address a question that will appear to be answered by said device;

(b) sensing user intent to use said device;

(c) providing a library storing potential responses;

(d) selecting one of said responses ostensibly in response to the question verbalized by the user to said device; and (e) textually displaying a selected said response as an answer by said device to said question verbalized by said user;

wherein said device having a housing, said housing having an off-center weight disposed within said housing for rotation about an axis in response to user movement of said device.

9. The method of claim 8, wherein:

step (c) includes providing said device with means for inputting into at least a portion of said library user-input; and step (e) includes displaying said user-input from said library.

10. The method of claim 8, further including for outputting at least one of (i) sound and (ii) a visual display during at least one of (a) a pre-response period, and (b) a duration of a displayed response.

11. A method of entertaining a user with a fortune telling device, the method comprising the following steps:

(a) providing a hand-holdable device adapted to allow a user to verbally address a question that will appear to be answered by said device;

(b) sensing user intent to use said device;

(c) providing a library storing potential responses;

(d) selecting one of said responses ostensibly in response to the question verbalized by the user to said device, where said selection can be altered by said randomizer circuit according to a user-input parameter into said device; and (e) electronically displaying a selected said response as an answer by said device to the question verbalized by the user.

12. The method of claim 11, wherein step (a) includes disposing said device within a generally spherical shaped housing.

* * * * *